US005688033A

United States Patent [19]

Fleisch et al.

[11] Patent Number: 5,688,033

[45] Date of Patent: Nov. 18, 1997

[54] DEVICE FOR THE ADJUSTABLE ATTACHMENT OF THE FRONT COVER OF A DRAWER ON FRAMES

[75] Inventors: Walter Fleisch; Jürgen Nachbaur, both of Lustenau, Austria

[73] Assignee: Alfit Aktiengesellschaft, Götzis, Austria

[21] Appl. No.: 708,086

[22] Filed: Aug. 30, 1996

[30] Foreign Application Priority Data

Sep. 7, 1995 [AT] Austria ..... 1481/95

[51] Int. Cl.[6] ..... A47B 88/00

[52] U.S. Cl. ..... 312/348.4; 312/348.1; 312/348.2; 312/263; 403/407.1

[58] Field of Search ..... 312/348.4, 348.1, 312/348.2, 263, 330.1; 403/406.1, 407.1, 403, 382, 231, 13

[56] References Cited

U.S. PATENT DOCUMENTS

| | | | |
|---|---|---|---|
| 4,815,796 | 3/1989 | Rock et al. | 312/263 |
| 5,281,022 | 1/1994 | Rock | 312/348.4 |
| 5,505,554 | 4/1996 | Lautenschlager | 312/348.2 X |
| 5,538,339 | 7/1996 | Rock et al. | 312/348.2 X |
| 5,540,515 | 7/1996 | Rock et al. | 403/407.1 |

FOREIGN PATENT DOCUMENTS

| | | | |
|---|---|---|---|
| 391 253 | 3/1990 | Austria . | |
| 395 812 | 8/1992 | Austria . | |
| 267477 | 5/1988 | European Pat. Off. | 312/348.4 |
| 289866 | 11/1988 | European Pat. Off. | 312/348.4 |
| 0 289 866 | 11/1988 | European Pat. Off. . | |
| 3801103 | 8/1988 | Germany | 312/348.4 |
| 3931155 | 3/1991 | Germany | 312/348.4 |
| 4 026 407 | 2/1992 | Germany . | |
| 2190831 | 12/1987 | United Kingdom | 312/348.4 |

*Primary Examiner*—Peter M. Cuomo
*Assistant Examiner*—James O. Hansen
*Attorney, Agent, or Firm*—Collard & Roe, P.C.

[57] ABSTRACT

The device comprises for each frame (1) a holding member (5) fixed at the front cover (2), which holding member has an aperture that is defined by clamping surfaces of a supporting plate (8) to be fixed at the front cover (2) and a pressure plate (6) connected therewith by means of a clamping screw (7), and whose width can be adjusted by the clamping screw (7) bridging the same, in which aperture the end of the frame (1) can be inserted by means of a lead-in slit (16) for the clamping screw extending therefrom. The lead-in slit (16) of the frame (1) constitutes a connecting link guide for an adapter (14) comprising the female thread for the clamping screw (7) and protruding from the pressure plate (6), and the end of the adapter (14) protrudes into the correspondingly increased lead-in aperture (12) for the clamping screw in the supporting plate (8), where the clamping screw (7) is supported with its head or a washer (18) on the supporting plate (8) outside the edge of the aperture.

10 Claims, 3 Drawing Sheets

DEVICE FOR THE ADJUSTABLE ATTACHMENT OF THE FRONT COVER OF A DRAWER ON FRAMES

Figure 1:
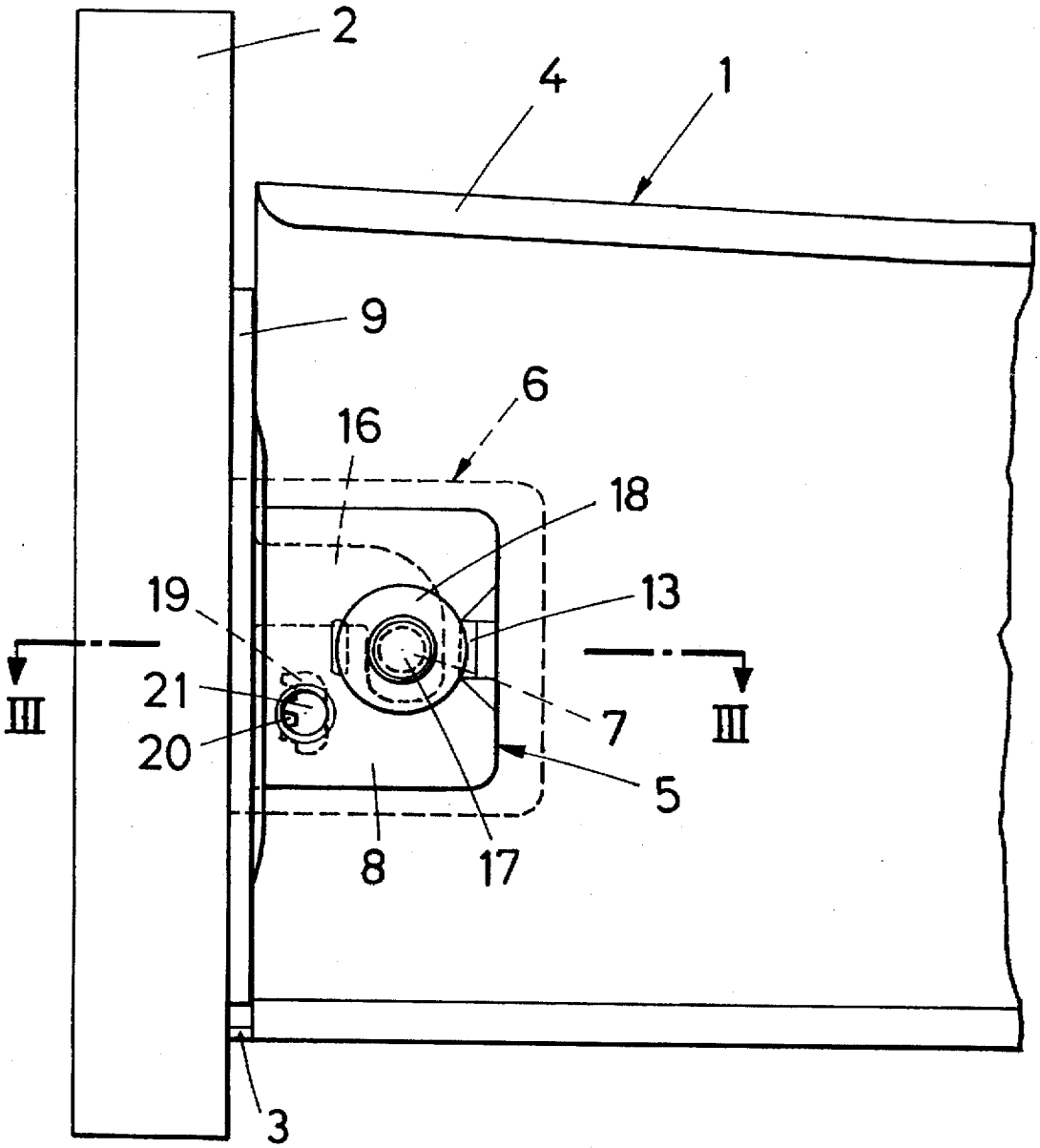

This invention relates to a device in accordance with the generic part of claim 1.

Such devices should provide for a quick insertion of the front cover in the frames and a precise adjustment of the front cover.

In such a accordance with the AT 391 253 B the supporting plate to be fixed at the front plate is provided on the inner side of the frame, and the pressure plate is provided on the outer side of the frame. On the supporting plate, threaded nipples are formed for receiving the clamping screws, which screws extend through the lead-in slit with unilateral clearance. The pressure plate constitutes a concave part whose cavity is directed towards the frame, where in the mounting position a straight edge of this part rests against a supporting flange of the supporting plate, and an opposing edge is directed to the outside at an acute angle and cooperates with inclined surfaces on clamps formed on the frame, so that upon tightening the clamping screw a transverse force is produced, which tends to twist the frame against the front cover. By means of these clamps, the frame is substantially held on the pressure plate. A height adjustment can be effected by a separate eccentric, which is mounted on the pressure plate and cooperates with one of the clamps of the frame. A precise or sufficient adjustment of the inclination of the front cover, however, creates some difficulties. The fact that it is absolutely necessary to form the clamps with the inclined surfaces on the frame requires a rather complex working of the frame and the use of sufficiently deformable and nevertheless sufficiently stable material for its production. The supporting plate and the clamping plate as well are relatively complicated parts which are difficult to manufacture.

Other known devices are even more complex or more difficult to use in practice.

In accordance with the EP 0 289 866 A a holding member constitutes a block formed in one piece on a flange fitted with dowels for fixing the front cover, in which block the lead-in aperture for the end of the frame is provided. The lead-in slit of the frame is provided as a slit closed at its ends, which extends parallel to the front cover. On the one clamping surface a holding wedge is formed, which engages in said slit, and from the other narrow side through the block the fixing screw is screwed into an aperture provided in the wedge. The screw can only be introduced in said aperture when the frame has been introduced. Before tightening the screw, a height adjustment is possible, where for securing the respective position an adjusting plate engaging in the frame and the clamping surface may have cooperating ribs.

It is therefore the object of the invention to create a device as stated above, which is easy to manufacture, if necessary as a pressed sheet metal part, requires only simple working of the frame, provides for a final assembly in a preassembled stated on the front cover with a risk of losing any fixing screws, and where no twisting forces are introduced by means of the fixing elements of the front cover.

This object is solved in a drawer comprising a side frame and a front cover, with a device for adjustably attaching the front cover to the side frame, which comprises a holding member for the side frame consisting of a supporting plate affixed to the front cover and a pressure plate defining a gap with the supporting plate, the gap having an adjustable width and an end portion of the side frame being inserted in the gap. The attaching device further comprises a clamping screw having a head, the clamping screw connecting the pressure plate to the supporting plate of the holding member, a threaded socket protruding from the pressure plate into, and engaging, a bore in the supporting plate, the bore having a rim and the head of the clamping screw being supported on the rim of the bore, and the clamping screw being engaged in the threaded socket and tightening of the clamping screw adjusting the width of the gap and clamping the end portion of the side frame between a clamping surface of the supporting plate and a pressure surface of the pressure plate bearing against the end portion of the side frame. The end portion of the side frame defines a guide slot for the threaded socket and the threaded socket passes through the guide slot, the guide slot extending inwardly from an end of the end portion of the side frame adjacent the front cover.

The device can completely be preassembled on the front cover with loosened clamping screw, where for the final assembly it is only necessary to slip on the frame or, vice versa, to introduce the socket in the slot of the frame when slipping on the fixing device. Due to the slotted shape and this socket an alignment of the frame with respect to the front cover can already be achieved. After the fine adjustment, the final fixing is effected by simply tightening the clamping screw.

By means of the guide, slot the stability is increased, the mutual alignment of supporting plate and pressure plate is facilitated without acting on the pressure screw, and the force with which the frame urges against the front cover can be introduced without additional parts on the frame.

If the threaded socket passes through the guide slot with a clearance, and the supporting plate has an inclined surface sloping down therefrom adjacent the head of the clamping screw or the washer at a side of the rim of the bore facing away from the front cover, tightening of the clamping screw will cause the head of the screw or the washer to engage the inclined surface and to generate a transverse force pressing the threaded socket into engagement with a side of the guide slot facing the front cover. This produces a force pulling the frame towards the front cover, and in addition the bracing is improved. The supporting plate can have supporting surfaces for the frame, which protrude at a distance from the bore rim so as to achieve that at least most of the bracing occurs at a distance from the bore. In this connection, an embodiment is preferred wherein the supporting plate has a resilient bulge adjacent the rim of the bore, tightening of the clamping screw causing the resilient bulge to be depressed.

A similar effect is additionally achieved with an embodiment wherein the pressure plate is rectangular and defines a clearance with the front cover when the clamping screw is tightened, and the pressure surface has a slight concavity when the clamping screw is loosened. When the concavity is eliminated upon tightening the clamping screw, a slight elastic deformation of the clamping plate is effected, and the elastic retaining force contributes to the additional retention of the clamping screw in the tightened position. The frame is safely fixed by the cooperating transverse and tensional forces.

In accordance with one preferred embodiment, the adjusting means is simply realized by providing a guide slot having a first leg extending substantially parallel to a longitudinal extension of the side frame inwardly from an end of the end portion of the side frame adjacent the front cover and a second leg extending downwardly from the first leg at an angle, and a vertical position adjusting device comprising another slot in the end portion of the side frame, the other slot extending substantially parallel to the second leg of the guide slot, the other slot having an edge defining notches, and the supporting plate defining an access aperture aligned with the other slot and capable of receiving an adjusting tool for engaging a respective one of the notches. In contrast to the known constructions, this requires no additional supports for adjusting eccentrics and the like.

In another embodiment, the vertical position adjusting device comprises a rotatable eccenter supported on the pressure plate and engaging the guide slot leg, the eccenter being accessible through an aligned aperture in the supporting plate capable of receiving an adjusting tool for rotating the eccenter. A washer may be positioned between the head of the clamping screw and the rim of that no changes must be made on the frame itself, and in particular the rotatable eccentric need not be supported on the same, that during the manufacture of the holding device the eccentric can already be mounted at an easily accessible point of the pressure plate, and finally that the eccentric guided in the guide slot with a distance from the socket effects an additional support of the frame on the fixing device.

Further details and advantages of the subject-matter of the invention can be taken from the subsequent description of figures.

Figure 2:
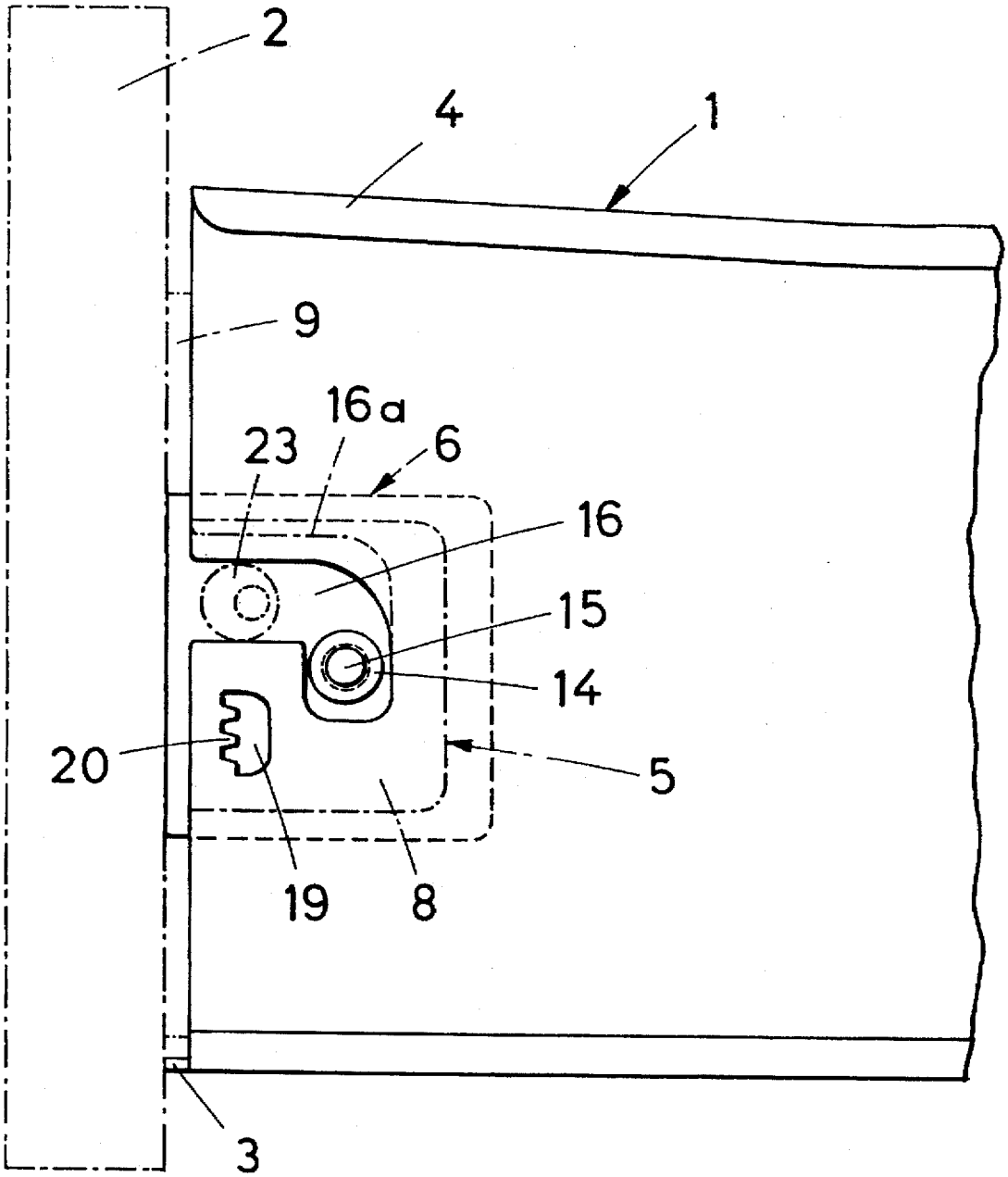
Figure 3:
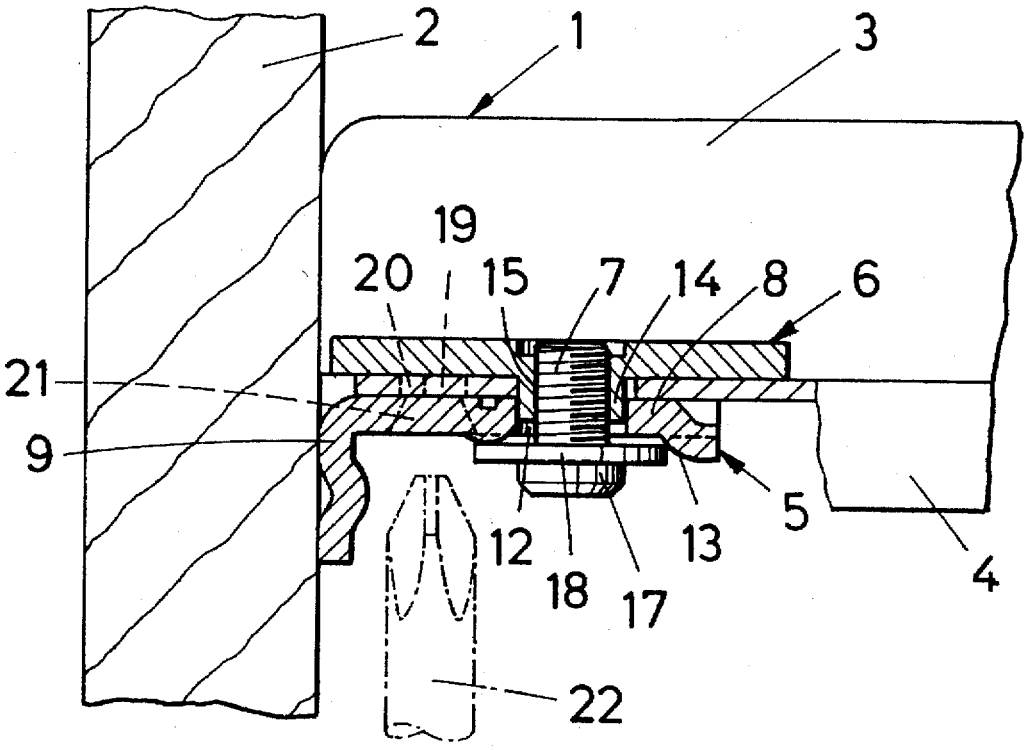
Figure 5:
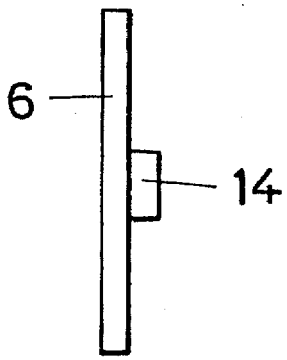
Figure 4:
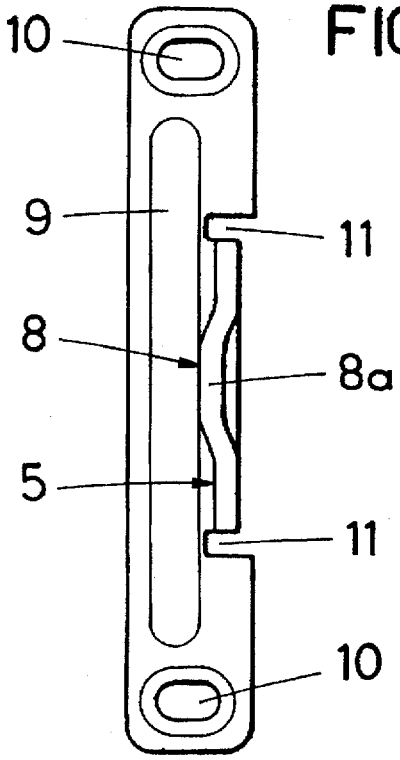

In the drawing, the subject-matter of the invention is illustrated by way of example, wherein:

FIG. 1 represents the end of one frame of a drawer with a completely mounted front cover in a side view, FIG. 2 in the same way as FIG. 1 represents the end of the frame, where the front cover is only schematically indicated in dash-dotted lines, and the front part of the fixing device is also indicated accordingly, FIG. 3 represents a section along line III—III in FIG. 1, FIG. 4 represents the front part of the fixing device as seen from the insertion side of the frame, and FIG. 5 represents the pressure plate in a side view.

Only the end of one frame 1 and front cover 2 of the drawer is illustrated. The frame 1 may be a pressed sheet-metal section, where a lower flange 3 extending up to the front cover 2 serves to support a drawer bottom, and an upper flange 4 may at the same time constitute the drawer rail of a drawer guideway.

For connecting the frame 1 with the front cover 2 a fixing device is provided, which comprises a holding member consisting of the parts 5 and 6 and a clamping screw 7. Part 5 consists of a supporting plate 8 of rectangular shape, from which a fixing flange 9 extends at an angle, which has lead-in holes 10 for screws effecting the connection with the front cover 2. As is in particular shown in FIG. 4, the supporting plate 8 is slightly released with respect to the flange 9 by means of notches 11 and is profiled towards the middle portion 8*a*, where in this middle portion 8*a* a lead-in aperture 12 is provided, from which descends an inclined guiding surface 13.

The part 6 is a likewise rectangular pressure plate, which in the assembled position extends parallel to the front cover with one edge thereof, can be slighly concave towards its center on a side carrying an socket 14, and inside the socket has a threaded hole 15 for receiving the clamping screw 7. In the end of the frame 1 an angled slit 16 is provided for engagement by the socket 14. Said adapter can engage in the slit with a clearance, and in the assembled position rests against the left-hand edge of the vertical terminal leg of the slit. The socket also partly engages in the correspondingly enlarged aperture 12. The clamping screw 7 has a head 17, which may be provided with a simple screw driver slit or a cross recess. In FIG. 1, the head of the screw 7 and a washer 18 provided below the screw head are indicated, where one edge of the washer is supported on the inclined surface 13.

The holding device is mounted on the front cover with only loosely tightened clamping screw 7. Therefore, the front cover with the gaps formed between 5 and 6 can be slid onto the frame 1, the slit 16 being guided by the socket 14. When the screw 7 is tightened, the inclined surface 13 cooperating with the washer produces a transverse force, so that the socket 14 is biased against the left-hand edge of the slit. Moreover, 8*a* and 6 are deformed, and the frame 1 is connected with the front cover 2 secured in its position.

In accordance with FIGS. 1–3, a further slit 19 may be provided in the frame parallel to the vertical leg of the slit 16, of which slit 19 the one edge 20 is provided with protrusions in the manner of a rack. Above the slit 19 a lead-in hole 21 is provided in the supporting plate 8, in which hole an adjusting tool 22 can be supported, which is indicated in dash-dotted lines in FIG. 3 and for instance is a Phillips screwdriver. By rotating the adjusting tool 22, a height adjustment of the fixing device including the front cover 2 can be effected with respect to the frame 1 by engagement of said tool in the teeth 20, the adjusted height being fixed by subsequently tightening the screw 7.

In accordance with one embodiment (FIG. 2), instead of the lastmentioned construction an eccentric 23 is supported on the pressure plate 6, which engages in the horizontal part of the slit 16, is supported on the lower edge of the slit, and can be provided with a screw slot, by means of which it can be rotated by means of a corresponding tool through the corresponding aperture of the supporting plate 8, so that there is likewise effected a height adjustment of the cover 2 with respect to the frame 1. The horizontal part of the slit has been widened, as indicated by 16a, so as not to impede the introduction of socket and eccentric into the slit.

We claim:

1. A drawer comprising a side frame, a front cover and a device for adjustably attaching the front cover to the side frame, the attaching device comprising:

(a) a holding member for the side frame consisting of
  (1) a supporting plate affixed to the front cover and
  (2) a pressure plate defining a gap with the supporting plate, the gap having an adjustable width and an end portion of the side frame being inserted in the gap, (b) a clamping screw having a head, the clamping screw connecting the pressure plate to the supporting plate of the holding member, (c) a threaded socket protruding from the pressure plate into, and engaging, a bore in the supporting plate,
  (1) the bore having a rim and the head of the clamping screw being supported on the rim of the bore, and
  (2) the clamping screw being engaged in the threaded socket and tightening of the clamping screw adjusting the width of the gap and clamping the end portion of the side frame between a clamping surface of the supporting plate and a pressure surface of the pressure plate bearing against the end portion of the side frame, and (d) the end portion of the side frame defining a guide slot for the threaded socket and the threaded socket passing through the guide slot, the guide slot extending inwardly from an end of the end portion of the side frame adjacent the front cover.

2. The drawer of claim 1, wherein the threaded socket passes through the guide slot with a clearance, and the supporting plate has an inclined surface sloping down therefrom adjacent the head of the clamping screw at a side of the rim of the bore facing away from the front cover, tightening of the clamping screw causing the head of the screw to engage the inclined surface and to generate a transverse force pressing the threaded socket into engagement with a side of the guide slot facing the front cover.

3. The drawer of claim 1, further comprising a washer positioned between the rim of the bore and the head of the clamping screw.

4. The drawer of claim 3, wherein the threaded socket passes through the guide slot with a clearance, and the supporting plate has an inclined surface sloping down therefrom adjacent the washer at a side of the rim of the bore facing away from the front cover, tightening of the clamping screw causing the washer to engage the inclined surface and to generate a transverse force pressing the threaded socket into engagement with a side of the guide slot facing the front cover.

5. The drawer of claim 1, wherein the supporting plate has a resilient bulge adjacent the rim of the bore, tightening of the clamping screw causing the resilient bulge to be depressed.

6. The drawer of claim 1, wherein the pressure plate is rectangular and defines a clearance with the front cover when the clamping screw is tightened, and the pressure surface has a slight concavity when the clamping screw is loosened.

7. A drawer comprising a side frame, a front cover, a device for adjustably attaching the front cover to the side frame, and a device for adjusting the vertical position of the front cover in relation to the side frame, the attaching device comprising:

(a) a holding member for the side frame consisting of
  (1) a supporting plate affixed to the front cover and
  (2) a pressure plate defining a gap with the supporting plate, the gap defining an adjustable width and an end portion of the side frame being inserted in the gap, (b) a clamping screw having a head, the clamping screw connecting the pressure plate to the supporting plate of the holding member, (c) a threaded socket protruding from the pressure plate into, and engaging, a bore in the supporting plate,
  (1) the bore having a rim and the head of the clamping screw being supported on the rim of the bore, and
  (2) the clamping screw being engaged in the threaded socket and tightening of the clamping screw adjusting the width of the gap and clamping the end portion of the side frame between a clamping surface of the supporting plate and a pressure surface of the pressure plate bearing against the end portion of the side frame, and (d) the end portion of the side frame defining a guide slot for the threaded socket and the threaded socket passing through the guide slot, the guide slot having a first leg extending substantially parallel to a longitudinal extension of the side frame inwardly from an end of the end portion of the side frame adjacent the front cover and a second leg extending downwardly from the first leg at an angle, and the vertical position adjusting device comprising (e) another slot in the end portion of the side frame, the other slot extending substantially parallel to the second leg of the guide slot, the other slot having
  (1) an edge defining notches, and (f) the supporting plate defining an access aperture aligned with the other slot and capable of receiving an adjusting tool for engaging a respective one of the notches.

8. The drawer of claim 7, wherein the notches form a rack extending substantially parallel to the front cover.

9. The drawer of claim 7, wherein the access aperture is shaped to receive a screw driver as the adjusting tool.

10. A drawer comprising a side frame, a front cover, a device for adjustably attaching the front cover to the side frame, and a device for adjusting the vertical position of the front cover in relation to the side frame, the attaching device comprising:

(a) a holding member for the side frame consisting of
  (1) a supporting plate affixed to the front cover and
  (2) a pressure plate defining a gap with the supporting plate, the gap defining an adjustable width and an end portion of the side frame being inserted in the gap, (b) a clamping screw having a head, the clamping screw connecting the pressure plate to the supporting plate of the holding member, (c) a threaded socket protruding from the pressure plate into, and engaging, a bore in the supporting plate,
  (1) the bore having a rim and the head of the clamping screw being supported on the rim of the bore, and
  (2) the clamping screw being engaged in the threaded socket and tightening of the clamping screw adjusting the width of the gap and clamping the end portion of the side frame between a clamping surface of the supporting plate and a pressure surface of the pressure plate bearing against the end portion of the side frame, and (d) the end portion of the side frame defining a guide slot for the threaded socket and the threaded socket passing through the guide slot, the guide slot having a leg extending substantially parallel to a longitudinal extension of the side frame inwardly from an end of the end portion of the side frame adjacent the front cover, and the vertical position adjusting device comprising (e) a rotatable eccenter supported on the pressure plate and engaging the guide slot leg, the eccenter being accessible through an aligned aperture in the supporting plate capable of receiving an adjusting tool for rotating the eccenter.

* * * * *